United States Patent [19]

Abel et al.

[11] Patent Number: 4,460,374

[45] Date of Patent: Jul. 17, 1984

[54] STABLE COMPOSITION FOR TREATING TEXTILE SUBSTRATES

[75] Inventors: Heinz Abel, Reinach; Carl Becker, Basel; Paul Schäfer, Riehen, all of Switzerland

[73] Assignee: Ciba-Geigy Corporation, Ardsley, N.Y.

[21] Appl. No.: 346,706

[22] Filed: Feb. 8, 1982

[30] Foreign Application Priority Data

| | | | |
|---|---|---|---|
| Feb. 12, 1981 | [CH] | Switzerland | 940/81 |
| May 26, 1981 | [CH] | Switzerland | 3439/81 |
| Oct. 30, 1981 | [CH] | Switzerland | 6946/81 |

[51] Int. Cl.[3] ..... D06P 1/90; D06P 1/653; C09K 11/60

[52] U.S. Cl. ..... 8/501; 8/583; 8/648; 427/158; 252/301.21; 252/301.25; 252/301.27; 252/301.28; 252/301.29; 252/301.32; 424/286; 424/311; 424/340

[58] Field of Search ..... 8/648, 583, 501; 252/301.21, 301.25, 301.27, 301.28, 301.29, 301.32; 427/158

[56] References Cited

U.S. PATENT DOCUMENTS

| | | | |
|---|---|---|---|
| 2,881,045 | 4/1959 | Mecco et al. | 8/583 |
| 3,203,753 | 8/1965 | Sherburne | 8/616 |
| 3,940,246 | 2/1976 | Defago et al. | 8/648 |
| 4,029,467 | 6/1977 | Defago et al. | 8/648 |
| 4,185,962 | 1/1980 | Gerber et al. | 8/552 |
| 4,229,176 | 10/1980 | Schafer et al. | 8/582 |
| 4,235,597 | 11/1980 | Reinert | 8/526 |

FOREIGN PATENT DOCUMENTS 1542369 3/1979 United Kingdom .

OTHER PUBLICATIONS

Chemical Abstracts 91 58637h (1979).

*Primary Examiner*—Maria Parrish Tungol
*Attorney, Agent, or Firm*—Edward McC. Roberts

[57] ABSTRACT

The invention relates to a stable composition for treating textile substrates which contains at least (a) an organic solvent which is sparingly soluble to insoluble in water and in which component (b) is dissolved and component (c) is dissolved or dispersed, (b) a vehicle for component (c) which is sparingly soluble to insoluble in water, and (c) a finishing agent which is sparingly soluble to insolube in water and which is soluble or dispersible in the vehicle (b). In addition to components (a), (b) and (c), the composition of the invention may also contain (d) a solid carboxylic acid which is sparingly soluble in water, and preferably soluble in the solvent (a), and/or (e) a polar organic solvent as well as further additives or assistants.

The novel composition, which preferably contains fluorescent whitening agents as finishing agents, is used in particular for whitening manmade textiles, especially made-up goods such as curtains or underwear.

27 Claims, No Drawings

STABLE COMPOSITION FOR TREATING TEXTILE SUBSTRATES

The present invention relates to a stable composition for treating textile substrates, in particular to a novel, stable concentrated or dilute liquid formulation of a fluorescent whitening agent for treating fabrics, especially finished goods, e.g. underwear and, in particular, curtains made from synthetic fibres, preferably from polyester fibres.

To whiten non-finished textile material, the normal procedure is to apply e.g. fluorescent whitening agents which are sparingly soluble in water to the textile material by an exhaust process or, in particular, by a pad process, and subsequently to thermofix the material at temperatures above 100° C. This process is virtually inapplicable to made-up goods at elevated temperatures. Attempts to whiten textiles, e.g. polyester curtains, at low temperatures have so far not produced practical results.

The same problem that arises in connection with whitening made-up goods also applies equally to dyeing or finishing these goods, e.g. with microbicides, softeners, UV absorbers, pigments, plasticisers or dirt repellents.

Accordingly, it is the object of the present invention to provide a novel method of application which makes it possible also to finish dye and, in particular to whiten made-up goods at low temperature. This object is accomplished by using for the said method of application, especially for whitening natural or synthetic fibre material, preferably polyester textiles or blends containing mainly polyester and, most preferably, curtains made from polyester fibres, specific compositions such as those described hereinafter. These compositions are most effective. They can be added direct to a treatment bath, e.g. a rinsing liquor, and then applied to the substrate, even at room temperature over a short period of time, to give a finish that can be readily washed off with alkali or, if desired, a permanent finish.

Accordingly, the present invention relates to a stable composition for treating textile substrates, which composition contains at least (a) an organic solvent which is sparingly soluble to insoluble in water and in which component (b) is dissolved and component (c) is dissolved or dispersed, (b) a vehicle for component (c) which is sparingly soluble to insoluble in water, and (c) a finishing agent which is sparingly soluble to insoluble in water and which is soluble or dispersible in the vehicle (b).

In addition to components (a), (b) and (c), the composition of the invention may also contain (d) a solid carboxylic acid which is sparingly soluble in water and preferably soluble in the solvent (a), and/or (e) a polar organic solvent as well as further additives or assistants.

Components (a), (b), (c), (d) and (e) may be used as individual compounds or in admixture. Preferred compositions contain all the indicated components (a) to (e) or, preferably, components (a), (b) and (c) or, most preferably, (a), (b), (c) and (d).

Organic solvents suitable for use as component (a) are preferably those which are volatile, water-insoluble or else of only limited solubility in water, and at the same time are able to form an organophilic or organic liquid phase. Limited solubility in water will be understood as meaning a solubility of less than 0.1%, i.e. at room temperature at most one gram of solvent should dissolve in one liter of water.

Representative examples of such solvents which form a second phase in water are: alcohols containing at least 4 carbon atoms, e.g. n-butanol, isobutanol, sec-butanol, pentanols, hexanols, trimethylhexanol, heptanols, octanols, benzyl alcohol, phenetol, phenoxyethanol, chlorophenoxyethanol, phenyl glycol, cyclopentanol, cyclohexanol; aromatic aldehydes such as benzaldehyde or furfurol; esters of an aliphatic or aromatic carboxylic acid, e.g. acetates such as ethyl acetate, isopropyl acetate, butyl acetate, amyl acetate, ethyl glycol acetate, benzyl acetate, acetoacetates, propionates, adipates, sebacates, succinates, malonates, benzoates or salicylates; ketones such as methyl ethyl ketone, methyl propyl ketone, methyl isobutyl ketone, methyl isoamyl ketone, ethyl butyl ketone, cyclohexanone, methylcyclohexanone; aromatic mono- or polycyclic hydrocarbons which are unsubstituted or substituted by halogen atoms or nitro groups, e.g. benzene, alkylbenzenes such as toluene, xylene, trimethylbenzene, ethyl benzene or methyl ethyl benzene, chlorobenzene, nitrobenzene, diphenylalkanes, alkyl-substituted diphenylalkanes, alkyl-substituted diphenyl, chlorodiphenyl, trichlorodiphenyl, dibenzyl toluene, benzylated xylenes, terphenyl, hydrogenated diphenyl or terphenyl, tetralin, naphthalene; aliphatic hydrocarbons having a flash point above 40° C.; polyhalogenated paraffins such as chloroparaffin; and also mesityl oxide, isophoron, acetophenone, dibutyl oxalate; benzonitrile, acrylonitrile, ethylene chloride, propylene carbonate, hexyl cellosolve, phenyl cellosolve. Mixtures of these solvents can also be used.

Particularly advantageous solvents are those having a flash point above 50° C., which are non-toxic, do not have a strong odour or at least have a pleasant odour, and which can be removed easily and completely. Examples of such solvents are aliphatic hydrocarbons, benzyl alcohol, phenoxyethanol, propylene carbonate, dimalonates, e.g. dimethyl and diethyl malonate; benzoates such as methyl, ethyl and butyl benzoate; diadipates, e.g. dimethyl and diethyl adipate; acetates, e.g. 2-ethylhexyl acetate, 2-n-butoxyethyl acetate, benzyl acetate or phenyl acetate, diethyl oxalate, dimethyl or diethyl succinate; oleyl alcohol or alkylbenzenes, e.g. trimethylbenzene and ethyl benzene; as well as diethylene glycol diethyl ether or 2,6-dimethylheptan-4-ol.

The solvent employed for dissolving the vehicle and which normally forms a second phase in water, is necessary only for the level application of the vehicle to the lipophilic substrate. After the application, the solvent is superfluous and should either evaporate or remain in the rinsing water.

The vehicle (b) can be liquid or solid or consist of a combination of solid and liquid substances. Liquid vehicles are organic lipophilic liquids having an extremely low vapour pressure (≦1 mm at 150° C.), e.g. so-called plasticisers. Particularly useful plasticisers are glycerol triesters such as triacetin, phosphoric acid esters; acyclic (aliphatic) dicarboxylic acid esters, e.g. adipates, such as dioctyl adipate, mono- or diphthalates, and also fatty acid esters or epoxy plasticisers.

The ester moiety of phthalic acid esters is derived preferably from aliphatic alcohols containing 1 to 22 carbon atoms. Very suitable phthalic acid esters are dimethyl phthalate, diethyl phthalate, dibutyl phthalate or di-2-ethylhexyl phthalate, di-3,5,5-trimethylhexyl phthalate, dioctyl phthalate or diisononyl phthalate. The preferred phthalates are the diesters of phthalic acid with alkanols containing 1 to 9 carbon atoms and especially dibutyl or dioctyl phthalate. Also very useful are mixed phthalic acid esters of fatty alcohols containing 6 to 22 carbon atoms, especially stearyl alcohol or $C_8$–$C_{22}$alfols, and alkylene glycols or alkylene glycol monoalkyl ethers. The alfols are linear primary alkanols. Preferred phthalic acid esters are those of the formula

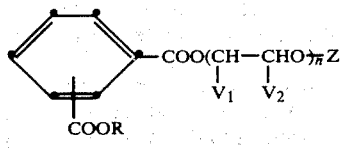

(1)

wherein R is an aliphatic hydrocarbon radical of 6 to 22 carbon atoms, preferably alkyl or alkenyl, each of 6 to 22, preferably 12 to 18, carbon atoms, one of $V_1$ and $V_2$ is hydrogen or methyl and the other is hydrogen, Z is hydrogen or alkyl of 1 to 4 carbon atoms, preferably methyl or ethyl, and n is 1 to 4, preferably 2 or 3. The ester group —COOR can be in the ortho-, meta- or para-position. The ester group —COOR is preferably in the ortho-position and so forms orthophthalic acid diesters.

The preferred meaning of R in formula (1) is alkyl of 8 to 22, preferably 12 to 18, carbon atoms, and each of $V_1$ and $V_2$ is preferably hydrogen. Z is preferably hydrogen.

Further particulars on the composition of the mixed phthalic acid esters suitable for use as the vehicle (b), including the production thereof, are disclosed in German Offenlegungsschrift No. 2 843 412.

In this invention, the amounts in which the phthalic acid diesters are used vary preferably from 1.5 to 30% by weight, most preferably from 2 to 20% by weight, based on the weight of the composition.

The vehicle is preferably solid and lipophilic. Desirably it should be able to dissolve the finishing agent (c) or, if this latter is insoluble, to keep it finely dispersed. The vehicle preferably dissolves the component (c) and is itself dissolved in the solvent (a). A suitable vehicle will be chosen in accordance with the nature of the finishing agent to be used and also in accordance with the end use of the composition of the invention. After application has been made, the vehicle normally acts as solid dissolving medium and, in particular, if the finishing agent (c) is not soluble in (a) and (b), as binder for the finishing agent, and may also act simultaneously as finishing agent (softener, dirt repellant, conditioning agent) for the material to be treated.

Particularly suitable vehicles for the composition of the invention are organosoluble synthetic resins, e.g. petroleum hydrocarbon resins, polyterpene resins, ester diol alkoxylates, ketone resins, polyamide resins, sulfonamide resins, silicone resins, isobutyraldehyde/formaldehyde resins, melamine/formaldehyde resins; homopolymers and copolymers of acrylic acid, methacrylic acid, acrylates, methacrylates, acrylamide, methacrylamide, vinyl butyral, vinyl chloride, vinylidene chloride, vinyl alcohol, styrene, vinyl acetate, vinyl acetate/vinyl laurate, and also vinyl acetal/vinyl acetate/vinyl alcohol terpolymers, polyolefins, polyepoxides, polyamides, polyaminoamides, polyurethanes, polyhydantoins, polycarbonates, polysulfones, modified polyvinylpyrrolidone, nitrocellulose; cellulose ethers, e.g. methyl cellulose, ethyl cellulose, hydroxyethyl cellulose, benzyl cellulose; cellulose esters, e.g. cellulose acetates, cellulose propionates, cellulose butyrates, cellulose acetobutyrates, as well as linear polyesters. Particularly preferred resins are acid resins, e.g. polyanhydride resins, as they can easily be removed again in alkaline washing processes.

For utilities in which finishes other than whitening are of interest, e.g. dyeing, conditioning etc., suitable polymers and resins (b) are also those which are not entirely colourless, such as rosin resins, alkyd resins, polyethylene waxes, phenol/formaldehyde resins and polybenzimidazoles. Such resins are described in more detail e.g. in the Coating Raw Materials Tables of Dr. Erich Karsten, 5th edition, 1972, Vincenz-Verlag, Hannover.

The amounts in which the synthetic resins are used vary preferably from 0.5 to 40% by weight, preferably from 5 to 25% by weight, based on the weight of the composition.

Instead of, or in combination with, neutral resins, suitable resins as component (b) are also phthalic acid monoesters which are obtained by esterification of phthalic acid with a fatty alcohol containing preferably 12 to 22 carbon atoms. Preferred phthalic acid monoesters have a softening point of at least 50° C. Examples of such carboxylic acid esters are monostearyl phthalates, monobehenyl phthalates and monoesters of phthalic acid and a mixture of $C_{10}$–$C_{14}$fatty alcohols, e.g. the alfols. The phthalic acid monoesters are preferably also used in combination with the acid component (d) and, in particular, with stearic acid.

Depending on whether the phthalic acid monoesters are used alone as component (b) or in combination with the neutral resins and/or with component (d), the amounts in which they are used varies preferably from 2 to 20% by weight, most preferably from 3 to 15% by weight, based on the weight of the entire composition.

Suitable finishing agents which are sparingly soluble to insoluble in water (component (c)), are preferably fluorescent whitening agents as well as dyes, e.g. disperse dyes, metal complex dyes, or solvent-soluble dyes, finely dispersed lipophilic coloured and white pigments, antistatic agents, microbicides, odorous substances, tannins, UV absorbers, moth repellents, water repellents, fabric softeners, plasticisers or dirt repellents. Depending on the end use, these finishing agents can be used individually or in combination. Sparing solubility and insolubility will be understood as meaning a solubility of less than 0.01% at room temperature.

Particularly preferred finishing agents for the process of this invention are fluorescent whitening agents which are sparingly soluble in water and which are used preferably for manmade fibres, e.g. polyamide fibres, polyacrylonitrile fibres and, in particular, polyester fibres.

The fluorescent whitening agents can belong to any class of compound. In particular, they are coumarins, triazole coumarins, benzocoumarins, oxazines, pyrazines, pyrazolines, diphenyl pyrazolines; stilbenes, styryl stilbenes, triazolylstilbenes, bis-benzoxazolylethylenes, stilbene bis-benzoxazoles, phenylstilbene benzoxazoles, thiophene bis-benzoxazoles, naphthalene bis-benzoxazoles, benzofuranes, benzimidazoles, furane bis-benzimidazoles and naphthalimides.

Mixtures of fluorescent whitening agents or fluorescent whitening agents with blue to violet shading dyes can also be used in the process of this invention. The fluorescent whitening agents can also be used in combination with lipophilised white pigments, in which case the white pigments are incorporated in thermoplasts, e.g. polyester or polyamide, and are present in fine dispersion.

Further important finishing agents which can be used in this invention especially for keratin fibres (wool), are microbicides, e.g. halogenated hydroxydiphenyl ethers and moth repellents, e.g. urea derivatives, or, in particular, 5-phenylcarbamoylbarbituric acid compounds and/or pyrethroids such as permethrin or cypermethrin.

The carboxylic acids which are sparingly soluble in water and suitable for use as component (d) are, in particular, fatty acids which preferably contain 8 to 24, most preferably 12 to 22, carbon atoms, and can be saturated or unsaturated, e.g. caprylic acid, pelargonic acid, capric acid, lauric acid, myristic acid, palmitic acid, stearic acid, coconut ($C_{10}$–$C_{16}$)fatty acid, tallow fatty acid, behenic acid, lignoceric acid, decenoic acid, dodecenoic acid, tetradecenoic acid, hexadecenoic acid, oleic acid, linolic acid, linolenic acid, ricinolic acid, eicosenoic acid, docosenoic acid, hiragonic acid, eleostearic acid, licanoic acid, parinaric acid, arachidonic acid or clupadonic acid.

Further carboxylic acids which can be used as component (d) in the practice of this invention are benzoic acid, hydroxybenzoic acid, gallic acid, phenylacetic acid or abietic acid. Preferred carboxylic acids are lauric acid, palmitic acid, behenic acid or, in particular, stearic acid. Component (d) is preferably used in combination with the neutral resin employed as component (b). In certain cases, the carboxylic acid (d) may also be used as vehicle (b). Component (d) is used in particular for improving the ease with which the finishes obtained in the practice of this invention can be removed by an alkaline washing-off.

The amounts in which the sparingly water-soluble carboxylic acid (d) are used preferably vary from 2 to 15% by weight, most preferably from 4 to 10% by weight, based on the weight of the composition.

In addtion, the compositions of this invention may contain, as polar solvent (e), a water-miscible organic solvent. The addition of this solvent is made to improve the dispersion of the composition in aqueous media in application, i.e. to disperse the droplets of the organic phase more finely so that they do not coalesce too rapidly. Examples of water-miscible organic solvents are aliphatic $C_1$–$C_3$alcohols such as methanol, ethanol or the propanols; alkylene glycols such as ethylene glycol or propylene glycol; monoalkyl ethers of glycols such as ethylene glycol monomethyl, monoethyl, or monobutyl ether, and diethylene glycol monomethyl or monoethyl ether; ketones such as acetone or diacetone alcohol; ethers such as diisopropyl ether, diphenyl oxide, dioxane, tetrahydrofurane, and also tetrahydrofurfuryl alcohol, pyridine, acetonitrile, N-methylpyrrolidone, $\gamma$-butyrolactone, N,N-dimethyl formamide, N,N-dimethyl acetamide, tetramethylurea, tetramethylene sulfone. Mixtures of these solvents can also be used.

Preferred compositions of this invention contain at least the following components:

(Aa) an organic solvent which is sparingly soluble to insoluble in water and has a flash point above 50° C., (Bb) an organosoluble synthetic resin and/or a phthalic acid mono- or diester or a mixture thereof, (Cc) a fluorescent whitening agent which is sparingly soluble in water, and, if desired, (Dd) a fatty acid of 12 to 22 carbon atoms.

In particular, finishes which can be readily washed off with alkali are obtained when the fatty acid is used.

Besides components (a), (b), (c) and, optionally, (d) and (e), and preferably instead of (e), the compositions of the invention may also contain small amounts of anionic, cationic, amphoteric or non-ionic surfactants. Non-ionic or cationic surfactants are preferred. Non-ionic surfactants are used in particular for weakly emulsifying the organic phase.

The anionic surfactants are advantageously derivatives of alkylene oxide adducts, for example,preferably sulfated, polyadducts of alkylene oxides, preferably of ethylene oxide and/or propylene oxide and also styrene oxide, with organic hydroxyl, carboxyl, amino and/or amido compounds containing aliphatic hydrocarbon radicals having a total of at least 4 carbon atoms, e.g. higher fatty alcohols, fatty acids, fatty amines, fatty acid amides or alkylphenols or mixtures of these compounds, which adducts contain acid ether groups or, preferably, acid ester groups, of organic or inorganic acids. These adducts can have a degree of alkoxylation of about 2 to 100, and contain especially 5 to 40 ethoxy and/or propoxy groups. The acid ethers or esters can be in the form of free acids or salts, e.g. alkali metal salts, alkaline earth metal salts, ammonium salts or amine salts. Preferred anionic surfactants are alkylarylsulfonates with straight chain or branched alkyl chain containing at least 6 carbon atoms in the alkyl moiety, e.g. nonyl- or dodecylbenzene sulfonates or diisobutylnaphthalenesulfonates, as well as sulfonates of dicarboxylic acid esters, e.g. dioctyl sulfosuccinate.

The cationic surfactants may contain, as basic substituents, e.g. amino, imino, quaternary ammonium or immonium, tertiary phosphino, quaternary phosphonium or sulfonium groups, and also thioronium or guanidinium groups. Preferred basic substituents are tertiary amino groups and, in particular, quaternary ammonium groups. These contain, as N-substituents, aliphatic, cycloaliphatic or araliphatic groups, whilst the N-substituents may also form 5- to 8-membered, especially 6-membered, rings.

Particularly suitable cationic surfactants which may be used in the practice of this invention are quaternary ammonium compounds of the formula

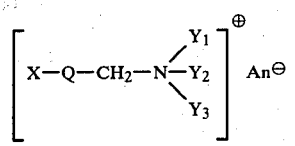

(2)

wherein X is an aliphatic hydrocarbon radical of 6 to 22, preferably of 10 to 18, carbon atoms, or a cycloaliphatic radical of 5 to 12 carbon atoms, each of $Y_1$ and $Y_2$ is lower alkyl, preferably methyl or ethyl, or both together with the nitrogen atom to which they are attached, form a 5- or 6-membered saturated heterocyclic radical, e.g. pyrrolidino, piperidino or morpholino, $Y_3$ is lower alkyl, hydroxy-lower alkyl, cyano-lower alkyl, carbamoyl-lower alkyl or aralkyl such as benzyl, or $Y_1$, $Y_2$ and $Y_3$, together with the nitrogen atom to which they are attached, form a pyridine ring which is unsubstituted or substituted by lower alkyl, Q is the direct bond or oxygen, and $An^{\ominus}$ is the anion of an organic or inorganic acid, e.g. the chloride, bromide or methanesulfonate ion.

Lower alkyl generally denotes those groups or group constituents which contain 1 to 5, in particular 1 to 3, carbon atoms, e.g. methyl, ethyl, n-propyl, isopropyl, sec-butyl, tert-butyl or amyl.

Particularly preferred quaternary ammonium compounds are n-dodecyloxymethyl-trimethylammonium chloride, n-dodecyltrimethylammonium chloride and, especially, N-cocosyl-N,N-dimethyl-N-benzylammonium chloride.

Further cationic surfactants are the quaternary polyammonium polymers which are described in German Offenlegungsschrift specifications Nos. 2 657 582, 2 824 743, 2 840 785 and 2 857 180.

Suitable cationic surfactants are also amines or polyamines which contain 2 or more, preferably 2 to 5, basic nitrogen atoms, and which contain at least one polyglycol ether chain and at least one lipophilic substituent (e.g. alkenyl or alkyl, each of 8 to 22 carbon atoms) and which can be partially or completely quaternised.

Examples of suitable amphoteric surfactants are amines or polyamines which contain 2 or more, preferably 2 to 5, basic nitrogen atoms, and which contain at least one acid etherified or esterified polyglycol ether chain and at least one lipophilic substituent, and which can be partially or completely quaternised. Especially preferred amphoteric surfactants are the acid monosulfuric acid esters of reaction products of 1 mole of a fatty amine or mixture of fatty amines, e.g. of tallow fatty amine, with 2 to 15 moles of ethylene oxide.

The non-ionic surfactants are preferably alkylene oxide adducts of 1 to 50 moles of alkylene oxide, e.g. ethylene oxide and/or propylene oxide, with 1 mole of an aliphatic monoalcohol containing at least 4 carbon atoms, preferably 8 to 22 carbon atoms, of a trihydric to hexahydric aliphatic alcohol containing 3 to 6 carbon atoms, of a phenol which is unsubstituted or substituted by alkyl or phenyl, or of a fatty acid containing 8 to 22 carbon atoms. It is preferred to use block polymers of ethylene oxide and propylene oxide. These block polymers preferably have the formulae $$HO\,(C_2H_4O)_{m1}-(C_3H_6O)_y-(C_2H_4O)_{m2}H \quad (3)$$

or $$HO(C_3H_6O)_{y1}-(C_2H_4O)_m-(C_3H_6O)H_{y2} \quad (4)$$

and may have a molecular weight of 2000 to 10,000. The content of ethylene oxide ($m_1+m_2$ or m) is 10 to 85% by weight, and the propylene oxide content (y or $y_1+y_2$) is 15 to 90% by weight.

Non-ionic surfactants which are especially preferred as emulsifiers are the adducts of 2 to 15 moles of ethylene oxide and 1 mole of fatty alcohol or fatty acid, each of 8 to 18 carbon atoms, or 1 mole of alkylphenol containing 4 to 12 carbon atoms in the alkyl moiety.

The anionic, amphoteric and non-ionic surfactants are preferably used in an amount of 0.1 to 1% by weight, based on the entire composition, whereas the cationic surfactants are used in an amount up to 15% by weight, preferably however up to at most 3% by weight.

If desired, non-reactive or weakly reactive lipophilised pigments may also be used, with or without surfactants as assistants. Examples of such pigments are: talcum, titanium dioxide, zinc oxide, zinc sulfide, chalk, clays such as kaolin, as well as organic pigments, e.g. urea/formaldehyde or melamine/formaldehyde condensation products. Particularly preferred pigments are those white pigments which are lipophilised and simultaneously whitened by coating them with a fluorescent whitening agent which is incorporated in a polymer, e.g. polyester.

The compositions of the invention can be prepared by simple stirring of the components (a), (b) and (c) and, optionally, (d), (e) and/or surfactants, if desired with gentle heating, to give homogeneous mixtures which are storage stable at room temperature.

The compositions of the invention conveniently contain

- 2 to 95% by weight, preferably 20 to 90% by weight, of component (a),
- 0.5 to 40% by weight of component (b),
- 0.1 to 20% by weight of component (c),
- 0 to 15% by weight, preferably 4 to 10% by weight, of component (d),
- 0 to 90% by weight, preferably 10 to 75% by weight, of component (e),
- 0 to 3% by weight of an anionic, cationic, amphoteric and/or non-ionic surfactant, in each case based on the weight of the entire composition.

These compositions are preferably stable liquid formulations which, depending on the formulation, can be used undiluted or diluted in the form of solutions, with components (a) and (e) being suitable solvents. When prediluted with water, they can also be used as liquid two-phase system.

If the compositions of the invention contain fluorescent whitening agents as finishing agents, the novel formulations can be employed for whitening synthetic, regenerated or natural organic fibre materials of the most diverse kind which may be in the form of filaments, fibres, flocks or bonded fibre webs. The compositions are preferably used for treating, especially for whitening, organic fibre material, in particular synthetic fibre material.

Suitable fibre material which may be whitened with the compositions of the invention comprises e.g. manmade fibres of natural polymers of (i) vegetable origin, e.g. cellulosic fibres such as acetate and triacetate fibres, and vegetable protein fibres, and (ii) of animal fibres such as animal protein fibres.

Preferred fibres are manmade fibres of synthetic polymers such as polycondensate fibres (polyester, polyurea and polyamide fibres), polymer fibres (polyamide, polyacrylonitrile, modacrylic, polypropylene, polyvinyl acetal, polyvinyl chloride, polyvinylidene chloride, polyfluoroethylene fibres), polyaddition fibres (such as polyurethane fibres).

In particular, the compositions of the invention are used for whitening linear polyester fibres. By linear polyester fibres are meant synthetic fibres which are obtained e.g. by condensation of terephthalic acid with ethylene glycol or of isophthalic acid or terephthalic acid with 1,4-bis(hydroxymethyl)cyclohexane, as well as copolymers of terephthalic acid and isophthalic acid.

The substrates to be treated can in certain cases also be obtained from conventional natural fibre materials, e.g. silk or, in particular, wool.

The fibre materials can also be used as blends with each other or with other fibres, e.g. polyacrylonitrile/- polyester blends, polyamide/polyester blends, polyester/wool blends and, provided the amount of the cellulose component is not greater, polyester/cotton and polyester/viscose staple fibre blends.

The textile material to be treated can be in different states of processing, e.g. loose material, knitted goods such as knits and wovens, yarns in package or muff form. It is preferred to treat finished goods, e.g. curtains and underwear.

The amounts in which the compositions of the invention are added to the treatment liquors, e.g. whitening baths or mothproofing formulations, vary from 1 to 40% by weight, preferably from 10 to 15% by weight, based on the weight of the substrate, or from 0.1 to 100 g, preferably 1 to 25 g, per liter of treatment liquor. Treatment is preferably carried out from an aqueous bath by the exhaust method. The liquor ratio may accordingly be chosen within a wide range, e.g. 1:4 to 1:100, preferably 1:20 to 1:70.

Depending on the desired effect, the treatment liquors may contain additional additives and assistants, e.g. bleaching agents, oxidants, light stabilisers, antioxidants and/or finishing agents.

The temperature at which the substrate is treated is normally in the range from 10° to 96° C., preferably from 15° to 40° C.

If desired, the whitening step can be combined with a prewash, in which the substrate is treated before the whitening procedure with an aqueous liquor which contains a conventional detergent, and then carefully rinsed.

The process of this invention gives substrates which have the desired finish.

The invention is illustrated by the following Examples, in which percentages are by weight, unless otherwise stated.

EXAMPLE 1

A polyester curtain having a weight of 2000 g is put into a washing machine and given a normal wash at 40° C. for minutes with a curtain detergent, and rinsed. The curtain is then treated for 10 minutes at room temperature with an aqueous liquor (liquor ratio 1:20) which contains 400 g of a composition (1) consisting of 3% of dioctyl phthalate,
25% of butyl benzoate,
25% of aliphatic hydrocarbons (b.p. 185°–210° C.),
39.55% of benzyl alcohol,
7% of a copolymer of vinyl toluene/acrylate with a softening temperature of 48.5° C. (refractive index 1.558).
0.2% of a block polymer consisting of 20% of ethylene oxide and 80% of propylene oxide and having a molecular weight of 5000, and
0.25% of a fluorescent whitening agent of the formula

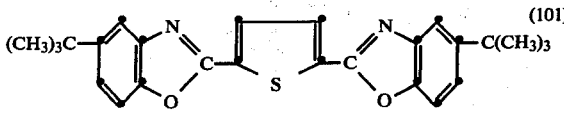

(101)

The curtain is then centrifuged and dried in the air. A pure white curtain with a dry, soft handle is obtained.

A finished fabric with a very pleasing permanent white effect is obtained by treating a washed and distinctly yellowed polyamide 66 curtain having a weight of 4000 g by the same procedure as described above.

Very level white effects are obtained on fibre substrates by replacing the 0.2% of block polymer by the same amount of a mixture of calcium dodecylbenzenesulfonic acid and castor oil which has been ethoxylated with 35 moles of ethylene oxide.

EXAMPLE 1

50 g of a polyester curtain material are agitated for 5 minutes at room temperature in 2500 ml of an aqueous liquor which contains 10 g of a composition (2) consisting of 4% of dibutyl phthalate,
64.5% of methyl ethyl benzene and trimethylbenzene,
25% of benzyl alcohol,
5.5% of a thermoplastic aromatic copolymer resin (m.p. 120° C.), and 0.5% of an α-copper phthalocyanine which has been predispersed by salt kneading in 0.5% of a modified rosin ester.

The curtain material is then rinsed with water and dried. A level blue pigment dyeing is obtained on the material.

EXAMPLE 3

5 g of a polyester curtain material is agitated for 5 to 10 minutes at room temperature in 250 ml of an aqueous liquor which contains 1 g of a composition (3) consisting of 71% of isobutanol
25.85% of toluene,
1.5% of a condensation resin of cyclohexanone and formaldehyde,
1.5% of a terpolymer of 80–77% of vinyl acetal, 2% of vinyl acetate and 18–21% of vinyl alcohol, and 0.15% of a fluorescent whitening agent of the formula (101).

The curtain material is then rinsed and dried. The originally yellowed material is distinctly whiter and has a good finish.

EXAMPLE 4

The proeedure of Example 3 is repeated, using instead of composition (3) equal amounts of a composition (4) consisting of 20% of cyclohexanone,
24.5% of benzyl alcohol,
35.5% of xylene,
10.5% of ethyl glycol acetate,
9% of a terephthalic acid copolyester based on terephthalic acid and aliphatic diols having an average molecular weight of 18–20,000, and 0.5% of a fluorescent whitening agent of the formula (101).

A curtain with a markedly improved white effect and a full soft handle is obtained.

Instead of the polyester curtain material, other knit fabrics as well as polyamide or polyacrylonitrile fabrics can also be whitened in the same manner and with the same success.

EXAMPLE 5

The procedure of Example 3 is repeated, using instead of composition (3) equal amounts of a composition (5) consisting of 12.25% of benzyl alcohol,
55% of methyl isobutyl ketone,
20% of methyl ethyl benzene and trimethylbenzene,
10% of a medium hard butyl methacrylate polymer,
2.5% of N-cocosyl-N,N-dimethyl-N-benzylammonium chloride,
0.25% of a fluorescent whitening agent of the formula (101), or of a composition (6) consisting of 12.25% of benzyl alcohol,
55% of methyl isobutyl ketone,
—20% of aliphatic hydrocarbons (b.p. 185°–210° C.),
10% of a copolymer of vinyl toluene/acrylate with a softening temperature of 48.5° (refractive index: 1.558),
2.5% of N-cocosyl-N,N-dimethyl-N-benzylammonium chloride,
0.25% of a fluorescent whitening agent of the formula (101).

Curtain material with a markedly improved white effect and a full soft handle is also obtained.

EXAMPLE 6

In a dyeing machine, 100 g of polyester knitted fabric, which has been initially dyed with 0.1% of a disperse dye of the formula (102)

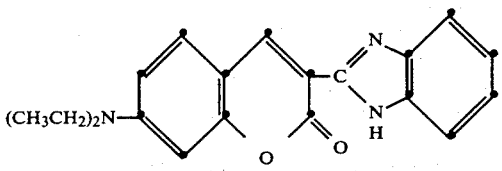

are treated at room temperature with an aqueous liquor (liquor ratio 1:40) which contains 900 ml of a composition (7) consisting of 45% of benzyl alcohol,
42.1% of methyl ethyl benzene and trimethylbenzene,
6% of a 50/50 copolymer of n-butyl/isobutyl methacrylate,
4% of a polyester plasticiser,
0.2% of a calcium dodecylbenzenesulfonate,
0.2% of an emulsifier of the formula (21)

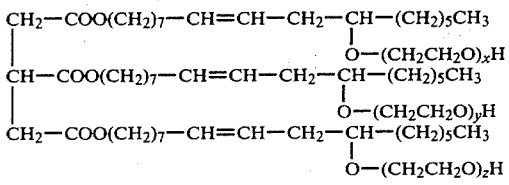

$x + y + z = 35$ and 2.5% of a UV absorber of the formula (103)

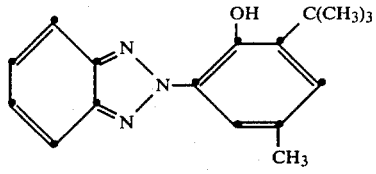

The textile material is then centrifuged and dried. This treatment gives a yellow knitted fabric with diminished fluorescence in UV light. The lightfastness of the dyeing is markedly improved.

EXAMPLE 7

2500 g of wollen articles of clothing are washed normally in a domestic washing machine. Instead of an after-rinse softener, there are added 500 g of a composition (8) consisting of 42% of methyl ethyl benzene and trimethylbenzene,
28.6% of ethylene glycol monoethyl ether,
5% of a 50/50 copolymer of n-butyl/isobutyl methacrylate,
4% of a polyester plasticiser,
0.2% of a calcium dodecylbenzenesulfonate (65%).
0.2% of en emulsifier of the formula (21), and 20% of 2,4,4'-trichloro-2'-hydroxydiphenyl ether, and the prewashed wool is then treated for 10 minutes at room temperature. The goods are then centrifuged and dried. A well disinfected fabric is obtained. (Inhibitory zone test according to ATCC 6538).

EXAMPLE 8

1000 g of polyester curtain material are washed and rinsed as described in Example 1. The material is then treated for 10 minutes at room temperature with an aqueous liquor (liquor ratio 1:20) which contains 200 g of a composition (9) consisting of 3% of dibutyl phthalate,
40.8% of benzyl alcohol,
49% of butyl benzoate,
7% of polyanhydride resin of the formula (104)

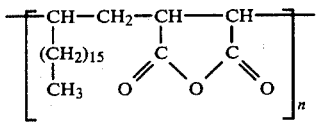

and 0.2% of a fluorescent whitening agent of the formula (105)

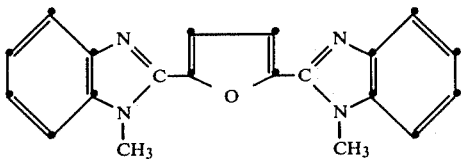

The material is then centrifuged and dried. A very good white effect is obtained compared with only a washed curtain material. The fluorescent film applied to the fibres can be completely removed by an alkaline washing-off.

EXAMPLE 9

1000 g of a polyester curtain material and put into a washing machine and given a normal wash at 40° C. with a curtain detergent for 20 minutes. The material is then treated for 10 minutes at room temperature with an aqueous liquor (liquor ratio 1:60) which contains 200 g of a composition (10) consisting of 42% of methyl ethyl benzene and trimethylbenzene,
42.35% of diethyl adipate,
8.5% of stearic acid,
6.5% of a copolymer of vinyl toluene/acrylate with a softening temperature of 48.5° C. (refractive index 1.558),
0.3% of a block polymer consisting of 20% of ethylene oxide and 80% of propylene oxide and having a molecular weight of 5000, and 0.35% of a fluorescent whitening agent of the formula (101).

The curtain material is then centrifuged and dried in the air. A pure white effect is obtained on the curtain material. The very strong blue fluorescent finish can be removed completely by an alkaline wash.

Readily washable white curtain material is also obtained by using, instead of stearic acid, equal parts by weight of lauric acid, behenic acid or palmitic acid.

EXAMPLE 10

The procedure of Example 9 is repeated using, instead of composition (10), equal amounts of one of compositions (11) to (16). Excellent white finishes which can easily be washed off are also obtained on curtain material. Compositions (11) to (16) are formulated as follows:

Composition (11)

42% of methyl ethyl benzene and trimethylbenzene
42.45% of diethyl adipate,
6.5% of monobehenyl phthalate,
8.5% of a copolymer of vinyl toluene/acrylate with a softening point of 48.5° C. (refractive index 1.558),
0.3% of a block polymer consisting of 20% of ethylene oxide and 80% of propylene oxide and and having a molecular weight of 5000, and 0.25% of a fluorescent whitening agent of the formula (101).

Composition (12)

50.35% of dimethyl adipate,
34% of methyl ethyl benzene and trimethylbenzene,
6% of a condensation resin of cyclohexanone and formaldehyde,
7% of stearic acid,
2% of a monoester of phthalic acid and a $C_8$–$C_{10}$ fatty alcohol,
0.3% of a block polymer consisting of 20% of ethylene oxide and 80% of propylene oxide and having a molecular weight of 5000, and 0.35% of a fluorescent whitening agent of the formula (101).

Composition (13)

42.7% of benzyl acetate,
41.7% of benzyl alcohol,
11% of a 50/50 copolymer of n-butyl/isobutyl methacrylate,
4% of a monoester of phthalic acid and a $C_{10}$–$C_{14}$ fatty alcohol,
0.2% of a block polymer consisting of 20% of ethylene oxide and 80% of propylene oxide and having a molceular weight of 5000, and 0.4% of a fluorescent whitening agent of the formula (101).

Composition (14)

39.3% of dimethyl adipate,
33% of aliphatic hydrocarbons (b.p. 185°–210° C.),
12% of butyl benzoate,
7% of a thermoplastic aromatic copolymer resin (m.p. 120° C.)
3% of monobehenyl phthalate,
5% of lauric acid,
0.3% of a block polymer consisting of 20% of ethylene oxide and 80% of propylene oxide and having a molecular weight of 5000, and 0.4% of a fluorescent whitening agent of the formula (101).

Composition (15)

27.4% of benzyl alcohol,
26.9% of benzyl acetate,
26.9% of aliphatic hydrocarbons (b.p. 185°–210° C.),
3.2% of oleyl alcohol,
15% of a monoester of phthalic acid and a $C_{10}$–$C_{14}$ fatty alcohol,
0.2% of a block polymer consisting of 20% of ethylene oxide and 80% of propylene oxide and having a molecular weight of 5000, and 0.4% of a fluorescent whitening agent of the formula (101).

Composition (16)

58% of methyl ethyl benzene and trimethylbenzene,
26.25% of diethyl adipate,
7.5% of stearic acid,
2% of monobehenyl phthalate,
5.5% of a copolymer of vinyl toluene/acrylate with a softening temperature of 48.5° C. (refractive index: 1.558),
0.5% of N-cocosyl-N,N-dimethyl-N-benzylammonium chloride, and 0.25% of a fluorescent whitening agent of the formula (101).

EXAMPLE 11

A prewetted wool fabric of 50 g dry weight is drawn for 60 seconds at 20° C. through 250 g of an aqueous liquor which has been adjusted to pH 5 with acetic acid and in which 10 g of the following composition (17) have been pre-emulsified:

46.6% of diethyl adipate,
46.1% of methyl ethyl benzene and trimethylbenzene,
6% of a copolymer of vinyl toluene/acrylate with a softening temperature of 48.5° C. (refractive index: 1.558),
1.5% of dioctyl phthalate,
0.25% of permethrin (3-phenoxybenzyl (1RS)-cis,-trans-3-(2,2-dichlorovinyl)-2,2-dimethylcyclopropanecarboxylate),
0.05% of 5-(3,4-dichlorophenyl)carbamoyl-1,3-dimethylbarbituric acid, and 0.3% of a block polymer consisting of 20% of ethylene oxide and 80% of propylene oxide and having a molecular weight of 5000.

The wool fabric is then squeezed out between metal rollers and dried at 70°–80° C. After this treatment the bath is completely exhausted. The treated wool fabric has a washfast finish with 95–100 ppm each of pyrethroid and barbiturate and is completely protected against larvae that feed on keratin, in particular larvae of the webbing clothes moth (*Tineola binelliella*) and of the common clothes moth (*Tinea pellionella*), of the fur beetle (*Attagenus piceus*) and of the carpet beetle (*Anthrenus vorax*).

EXAMPLE 12

The procedure of Example 11 is repeated, using instead of composition (17) an equal amount of composition (18) consisting of 31.8% of benzyl alcohol,
63% of methyl ethyl benzene and trimethylbenzene,
5% of a polyaminoamide of dimeric and trimeric fatty acids and a polyamine, e.g. triethylenetetramine,
0.5% of cypermethrin ((RS)-α-cyano-3-phenoxybenzyl (1RS)-cis,trans-3-(2,2-dichlorovinyl)-2,2-dimethylcyclopropanecarboxylate),
0.05% of 5-(3,4-dichlorophenyl)carbamoyl-1,3-dimethylbarbituric acid, and
0.10% of a block polymer consisting of 20% of ethylene oxide and 80% of propylene oxide and having a molecular weight of 5000, to give likewise a wool fabric which is protected against feed damage caused by the larvae of moths and beetles.

EXAMPLE 13

800 g of polyester curtain are treated for 15 minutes in a wash container with an aqueous liquor which contains 150 g of a composition (19) consisting of 3% of dioctyl phthalate,
10% of 3,5,5-trimethylhexanol,
20% of a 50% solution in ethyl acetate of a vinyl acetate/vinyl laurate resin,
15% of urea/formaldehyde resin,
0.25% of a fluorescent whitening agent of the formula (101),
6% of N-cocosyl-N,N-dimethyl-N-benzylammonium chloride,
45% of ethylene glycol monoethyl ether.

The treatment is effected at room temperature, with stirring. The material is then rinsed and dried. The curtain has a very good white effect and also has a dry, slightly stiff handle.

EXAMPLE 14

500 g of polyester curtain are washed and rinsed as described in Example 13. The material is then treated for 10 minutes at room temperature with an aqueous liquor (liquor ratio 1:60) which contains 100 g of a composition (20) consisting of 4% of dioctyl phthalate,
5.5% of a polyterpene resin with a melting point of 120° C.,
0.5% of a fluorescent whitening agent of the formula (101),
1% of N-cocosyl-N,N-dimethyl-N-benzylammonium chloride,
64% of methyl ethyl benzene and trimethylbenzene,
24% of benzyl alcohol, and
0.001% of a dye of the formula

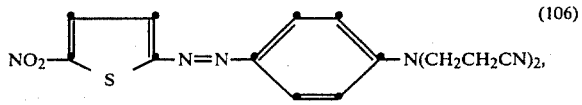

(106)

dissolved in 0.999% of N-methylpyrrolidone.

The curtain material is then centrifuged and dried in the air. An improved white effect is obtained compared with a material which has only been washed.

EXAMPLE 15

The procedure of Example 14 is repeated, using instead of composition (20) 100 g of a composition (21) or (22) which contains instead of the fluorescent whitening agent of the formula (101) 0.5% of a fuorescent whitening agent of the formula

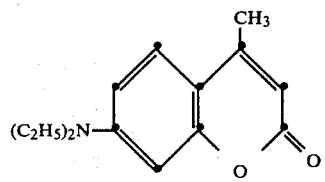

(107)

or 0.5% of a fluorescent whitening agent of the formula

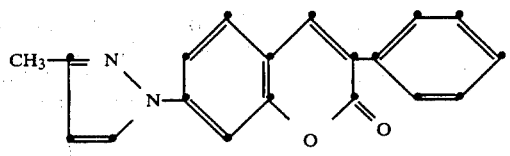

(108)

Similarly good white effects are obtained on curatin material.

EXAMPLE 16

The procedure of Example 14 is repeated, using instead of composition (20) 100 g of a composition (23) which contains instead of dioctyl phthalate, 4% of a phthalic acid mixed ester of the formula

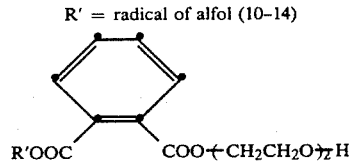

(11)

Curtain material with an excellent white effect and a dry handle is obtained.

EXAMPLE 17

5 g of polyamide 66 material are agitated for 10 minutes at room temperature in 200 ml of an aqueous liquor which contains 1 g of a composition (24) consisting of 2.5% of a phthalic acid mixed ester of the formula (11),
5% of a thermoplastic acrylate resin,
0.8% of a fluorescent whitening agent of the formula (101), 1% of N-cocosyl-N,N-dimethyl-N-benzylammonium chloride,
39.2% of benzyl alcohol,
26.5% of propylene carbonate, and
25% of toluene.

After the material has been treated it is rinsed, centrifuged and dried. The material has an improved white effect and a full, dry handle.

Markedly improved white effects are also obtained by treating, instead of polyamide 66 material, an equal amount of polyacrylonitrile or polyester material in similar manner.

EXAMPLE 18

1000 g of polyester curtain material are put into a washing machine and given a normal wash at 40° C. with a curtain detergent for 20 minutes and then rinsed. The material is then treated for 5 to 10 minutes at room temperature with an aqueous liquor (liquor ratio 1:60) which contains 200 g of a composition (25) consisting of 38.2% of aliphatic hydrocarbons (b.p. 185°-210° C.),
38.2% of diethyl adipate,
7.55% of stearic acid,
5.8% of a copolymer of vinyl toluene/acrylate with a softening point of 48.5° C. (refractive index: 1.558),
0.25% of a block polymer consisting of 20% of ethylene oxide and 80% of propylene oxide and having a molecular weight of 5000, and
10% of a micronised white pigment coated with polyester and treated with fluorescent whitening agents and which fluoresces in UV light.

The treated curtain material is then rinsed and dried in the air. A pure white material is obtained.

The white pigment used in this Example is prepared as follows:

With stirring and in an atmosphere of inert gas, 3 parts of titanium white and 47 parts of polyester (polyethylene glycol terephthalate) are dissolved in 650 parts of γ-butyrolactone in a pressure vessel over 20 minutes at 190°-195° C. The solution is then allowed to cool slowly to room temperature, whereupon the polyester precipitates in fine flocks along with the titanium dioxide pigment(primary particle size 1-2μ). The precipitate is isolated by filtration and treated at a liquor ratio of 1:20 for 20 minutes at 130° C. in an aqueous liquor which contains, based on the white pigment coated with polyester, 0.07% of two fluorescent whitening agents of the formulae

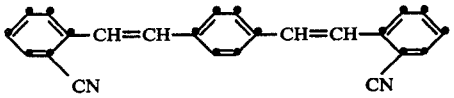

(109)

and

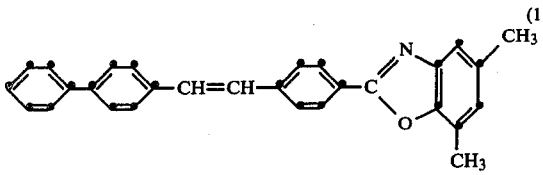

(110)

in microdispersion. The so treated white pigment is then isolated by filtration, rinsed and dried. The resultant titanium white coated with polyester exhibits bluish violet fluorescence in UV light. Instead of titanium dioxide, other very finely particulate white pigments, e.g. barium sulfate, magnesium oxide, zinc oxide, zinc sulfide, aluminium hydroxide, calcium carbonate or urea/formaldehyde condensate, e.g. having a BET surface area of 3 to 75 $m^2/g$, preferably 5 to 25 $m^2/g$, may also be coated in the same manner with polyester and given an aftertreatment with the same mixture of fluorescent whitening agents. Such fluorescing lipophilic whitening agents can also be incorporated into the preparation (25) and successfully applied to curtains.

EXAMPLE 19

If an additional 0.35% of a fluorescent whitening agent of the formula (101) and 0.002% of a violet shading dye of the formula

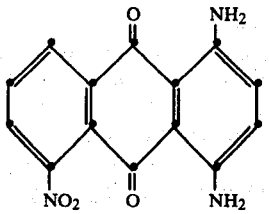

(111)

are stirred into the composition (25) described in Example 18 and the temperature is kept at 70° C. for 30 minutes until complete solution is attained, there is obtained, after cooling, a further preparation (26) which is applied to a washed polyester curtain in the same manner as described in Example 18. Increased white effects are obtained on the curtain. The finish on the curtain, which exhibits a strong blue fluorescence in UV light, can be completely removed again by an alkaline wash.

What is claimed is:

1. A process for whitening a textile, comprising the step of applying to the textile in an aqueous medium a composition which comprises (a) an organic solvent which is sparingly soluble to insoluble in water and in which component (b) is dissolved and component (c) is dissolved or dispersed,
(b) a vehicle for component (c) which is sparingly soluble to insoluble in water, and
(c) a fluorescent whitening agent which is sparingly soluble to insoluble in water and which is soluble or dispersible in the vehicle (b).

2. The process of claim 1 wherein the composition further comprises a solid carboxylic acid which is sparingly soluble in water.

3. The process of claim 2, wherein component (d) is a fatty acid containing 8 to 24 carbon atoms.

4. The process of claim 3, wherein the fatty acid has 12 to 22 carbon atoms.

5. The process of claim 1 wherein the composition further comprises a polar organic solvent.

6. The process of claim 1 wherein the textile contains synthetic fibers.

7. The process of claim 6 wherein the fibers are polyester fibers.

8. The process of claim 1, wherein component (a) is benzyl alcohol, phenoxyethanol, cyclohexanone, propylene carbonate, methyl isobutyl ketone, an acetate, a dimalonate, an adipate, a benzoate, an aliphatic hydrocarbon having a flash point above 50° C., an alkylbenzene or a mixture thereof.

9. The process of claim 8, wherein component (a) is benzyl alcohol, phenoxyethanol, propylene carbonate, a dimalonate, a benzoate, an acetate, dimethyl adipate, diethyl adipate, an aliphatic hydrocarbon having a flash point above 50° C., methyl benzene, trimethylbenzene, methyl ethyl benzene, ethyl benzene or a mixture thereof.

10. The process of claim 1, wherein the vehicle (b) is solid and lipophilic.

11. The process of claim 1, wherein component (c) is dissolved in the vehicle (b), which in turn is dissolved in the solvent (a).

12. The process of claim 1, wherein the vehicle (b) is an organosoluble synthetic resin or a polymer.

13. The process of claim 1, wherein the vehicle (b) is a phthalic acid monoester of a fatty alcohol containing 12 to 22 carbon atoms.

14. The process of claim 1, wherein the vehicle (b) is a phthalic acid diester, the ester moieties of which are derived from alkanols containing 1 to 9 carbon atoms.

15. The process of claim 1, wherein the vehicle (b) is a mixed phthalic acid diester, one ester moiety of which is derived from a fatty alcohol containing 6 to 22 carbon atoms and the other from an alkylene glycol or alkylene glycol monoalkyl ether.

16. The process of claim 1, wherein component (a) has a flash point above 50° C., and component (b) is an organo soluble synthetic resin, a phthalic acid monoester or a phthalic acid diester or a mixture thereof.

17. The process of claim 16, wherein the composition additionally contains (d) a fatty acid of 12 to 22 carbon atoms.

18. The process of claim 16, wherein component (a) is dimethyl adipate, diethyl adipate, butyl benzoate, benzyl acetate, an aliphatic hydrocarbon having a boiling point of 185°–120° C., benzyl alcohol, toluene, xylene, methyl ethyl benzene, trimethylbenzene, ethyl benzene or a mixture thereof.

19. The process of claim 1, wherein the composition additionally contains an anionic, cationic, amphoteric or non-ionic surfactant.

20. The process of claim 19, wherein the surfactant is a cationic surfactant.

21. The process of claim 20, wherein the cationic surfactant is a quaternary ammonium compound of the formula

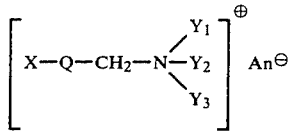

wherein X is an aliphatic hydrocarbon radical of 6 to 22 carbon atoms, or a cycloaliphatic radical of 5 to 12 carbon atoms, each of $Y_1$ and $Y_2$ is lower alkyl, or both together with the nitrogen atom to which they are attached, form a 5- or 6-membered saturated heterocyclic radical, $Y_3$ is lower alkyl, hydroxy-lower alkyl, cyano-lower alkyl, carbamoyl-lower alkyl or aralkyl, or $Y_1$, $Y_2$ and $Y_3$, together with the nitrogen atom to which they are attached, form a pyridine ring which is unsubstituted or substituted by lower alkyl, Q is the direct bond or oxygen, and An ⊖ is the anion of an organic or inorganic acid.

22. The process of claim 18, wherein the non-ionic surfactant is a block polymer of ethylene oxide and propylene oxide.

23. The process of claim 1, wherein the composition contains, based on the entire composition, 20 to 90% by weight of component (a),
0.5 to 40% by weight of component (b),
0.1 to 20% by weight of component (c),
0 to 15% by weight of component (d),
0 to 90% by weight of component (e), and
0 to 3% by weight of an anionic, cationic, amphoteric or non-ionic surfactant.

24. The process of claim 23, wherein the composition contains 4 to 10% by weight of component (d), based on the entire composition.

25. The process of claim 1, wherein the composition is applied to the textile in an amount of 1 to 40% by weight, based on the weight of the textile, or of 0.1 to 100 g per liter of treatment liquor.

26. The process of claim 1, wherein the composition is applied to the textile at a temperature in the range of 10° to 96° C.

27. The process of claim 26, wherein the temperature range is 15° to 40° C.

* * * * *